United States Patent [19]

Herber

[11] 3,979,327

[45] Sept. 7, 1976

[54] DYE SOLVENTS FOR PRESSURE-SENSITIVE COPYING SYSTEMS

[75] Inventor: John F. Herber, St. Louis, Mo.

[73] Assignee: Monsanto Company, St. Louis, Mo.

[22] Filed: Sept. 8, 1975

[21] Appl. No.: 611,116

[52] U.S. Cl. ..... 252/364; 252/316; 8/94 R

[51] Int. Cl.[2] ..... B01F 1/00

[58] Field of Search ..... 252/364, 316; 8/94

[56] References Cited

UNITED STATES PATENTS 3,846,331 11/1974 Konishi et al. ..... 252/364

*Primary Examiner*—Stephen J. Lechert, Jr.

*Attorney, Agent, or Firm*—William H. Duffey

[57] ABSTRACT

Solvent compositions useful to dissolve color formers employed in pressure-sensitive copying systems comprise:

A. About 45 to 55 weight percent of hydrogenated terphenyl having no greater than about 40% hydrogenation; and B. about 55 to 45 weight percent of i. hexylbenzene; or ii. a composition comprising about 45 to 75 weight percent $C_{10}$ to $C_{16}$ alkanes and the balance $C_7$ to $C_{10}$ alkylbenzenes.

4 Claims, No Drawings

DYE SOLVENTS FOR PRESSURE-SENSITIVE COPYING SYSTEMS

BACKGROUND OF THE INVENTION

1. Field of the Invention

The present invention relates to pressure-sensitive copying systems of the kind in which a substantially colorless color former (dye) held within microcapsules is reacted, upon rupturing of the microcapsules by an applied pressure, with a co-reactant material to form distinctive colored marks. More particularly, the present invention relates to improved dye solvent compositions useful in pressure-sensitive copying systems.

2. Description of the Prior Art

In one conventional pressure-sensitive copying system, the microcapsules are carried on one surface of a transfer sheet, referred to as a CB (coated back) sheet and the coreactant material is carried on one surface of a record sheet, referred to as a CF (coated front) sheet. In another embodiment, the microcapsules and the co-reactant material are carried on the same surface of a single sheet. In systems for making a plurality of copies, intermediate CFB (coated front and back) sheets are provided. The sheets are usually made of paper.

Most known CB sheets carry a coating of microcapsules, which may be separate or in capsular units, i.e., clusters of capsules. Each microcapsule comprises a wall of hydrophilic colloid material such as gelatin, containing a substantially colorless chromogenic material (color former) of basic reactant chemical properties which, in use, contacts and is colored by a co-reactant material.

The co-reactant material is typically a finely divided acidic compound which is also substantially colorless in its natural form. Commonly used co-reactant materials include organic polymers and inorganic clays which are applied to the CF sheet in a suitable paper coating binder material such as starch, casein, polymer or latex.

Distinctive colored marks occur on the CF sheet following rupture of the microcapsules through localized pressure from writing, typing or printing on the noncoated front surface of a CB sheet which is positioned with its coated back surface in contact with the coated front surface of a CF sheet.

The substantially colorless color former produces color only under acidic conditions, that is, upon contact with the acidic co-reactant of the CF sheet. The color former is always dissolved in a solvent and, in many cases, is diluted with kerosene or the like. It is therefore important that the color former solution possess the required physical and chemical properties.

Generally desirable properties of the color former solution are that it be easily encapsulated by conventional techniques; that it have good shelf life in the encapsulated form; and that it be stable at moderately elevated temperatures. It is also important that the mark produced as a result of the reaction between the color former and the coreactant develop rapidly, be fade resistant and be resistant to bleeding or feathering as a result of capillary action or other suface phenomena.

The dye solvent (color former solvent) functions to provide a carrier for the color former and a medium for the reaction between the color former and the acidic coreactant material. The solvent must be capable of holding the color former in solution within the microcapsule, of carrying the color former to the synthesized surface of the CF sheet when the microcapsule is ruptured, and of promoting or at least not inhibiting color development with the coreactant. In addition, since inadvertent rupture of the microcapsule is possible by careless handling, the solvent must be noninjurious to skin, clothing or environment.

The solvent is an important factor in determining the performance of the pressure-sensitive copying system in terms of stability of the sheets to heat and storage time, rate of color development, extent of color development, and durability of image. Certain prior art dye solvents have exhibited adequate print speed and color intensity on the widely used phenolic resin-coated CF sheets. In some cases, however, objectionable odors in the copying systems have been ascribed to the dye solvent itself. Such odors obviously detract from commercial acceptance of such copying systems even though the dye solvent performance is otherwise superior.

Many non-halogenated aromatic hydrocarbons are known to the art as dye solvents for pressure-sensitive copying systems. Among these are diaryl methanes, alkylnaphthalene, benzylnaphthalene, triaryl dimethanes, alkylated biphenyls, alkylated terphenyls and partially hydrogenated terphenyls.

Where the dye solvent (color former solvent) is partially hydrogenated terphenyl, the prior art teaches that the degree of hydrogenation can have significant effects on performance parameters such as print speed. The converse of "percentage hydrogenation" is sometimes referred to as "percentage aromaticity". Thus, where the dye solvent is said to comprise 40% hydrogenated terphenyl, it is said to possess 60% aromaticity. Such a dye solvent is referred to in U.S. Pat. No. 3,244,728 issued Apr. 5, 1966 as "a partially hydrogenated mixture of isomeric terphenyls (Monsanto HB-40)".

Belgian Pat. No. 795,255 issued Aug. 9, 1973 discloses an unexpected improvement in hydrogenated terphenyl dye solvents on clay CF sheet when the degree of hydrogenation is reduced from 40% to 35%, or when the aromaticity is increased from 60% to 65%.

Prior art disclosures of the use of partially hydrogenated terphenyls as dye solvents for pressure-sensitive copying systems are confined, for the most part, to single solvent systems. That is, the partially hydrogenated terphenyl is the only primary solvent within the microcapsule although, of course, a typical diluent such as kerosene is often present.

Belgian Pat. No. 795,255 (referred to above) illustrates the excellent performance of 30% hydrogenated terphenyl as a dye solvent when used with clay CF sheet. Such hydrogenated terphenyls, however, have been found to give generally unsatisfactory results when used with organic polymer type CF sheets. Thus, the commercial use of hydrogenated terphenyls as dye solvents for pressure-sensitive copying systems has been largely confined to CF sheets containing inorganic clay coatings.

There remains a need, therefore, for a superior dye solvent composition containing partially hydrogenated terphenyl which exhibits all the required properties in combination with modern resin type CF sheets.

It is thus an object of the present invention to provide partially hydrogenated terphenyl solvents for pressure-sensitive copying systems which are useful on resin CF sheets, particularly on phenolic resin CF sheets. Further objects of the present invention will become apparent from the following description and examples.

SUMMARY OF THE INVENTION

It has been surprisingly found that hydrogenated terphenyls having no greater than about 40% hydrogenation, and preferably having about 30% hydrogenation, when blended in controlled amounts with certain alkylbenzenes or alkylbenzene-containing compositions, will provide dye solvents having outstanding performance with resin CF sheets.

Thus, the improved solvent compositions of the present invention useful to dissolve color formers employed in pressure-sensitive copying systems comprise:

A. about 45 to 55 weight percent of hydrogenated terphenyl having no greater than about 40% hydrogenation; and B. about 55 to 45 weight percent of i. hexylbenzene; or ii. a composition comprising about 45 to 75 weight percent $C_{10}$ to $C_{16}$ alkanes and the balance $C_7$ to $C_{10}$ alkylbenzenes.

These solvent compositions surprisingly afford rapid color development and excellent color intensity on phenolic resin CF sheets whereas prior art applications of such hydrogenated terphenyls were generally successful only on inorganic clay CF sheets.

Preferred hydrogenated terphenyls useful in the dye solvent composition of this invention are those having about 30% hydrogenation (about 70% aromaticity).

DESCRIPTION OF PREFERRED EMBODIMENTS

The pressure-sensitive copying systems utilizing the improved dye solvents of the present invention may be prepared according to well known conventional procedures. Descriptions of methods for preparing the CB sheet and the CF sheet are to be found in the literature and such methods do not constitute a part of the present invention. Coating of the co-reactant material, whether inorganic clay or organic polymer type, is conducted according to such established procedures. Similarly, formation and application of microcapsules onto the CB sheet is fully disclosed in the literature. The solvent compositions of this invention may be substituted for conventional dye solvents in order to produce improved pressure-sensitive copying systems according to such conventional procedures.

The solvent compositions of the present invention are preferably utilized in combination with one or more of several conventional color formers of normally colorless form. One such class of color formers comprises colorless aromatic double bond organic compounds which are converted to a more highly polarized conjugated and colored form when reacted with an acidic sensitizing material on the CF sheet. A particularly preferred class of color formers includes compounds of the phthalate type such as crystal violet lactone (CVL) which is 3,3-bis(p-dimethylaminophenyl)-6-dimethylaminophthalide and malachite green lactone which is 3,3-bis(p-dimethylaminophenyl) phthalide. Other phthalide derived color formers include 3,3-bis(p-n-dipropylaminophenyl)phthalide, 3,3-bis(p-methylaminophenyl)phthalide, 3-(phenyl)-3-(indole-3-yl)phthalides such as 3-(p-dimethylaminophenyl)-3-(1,2-dimethylindol-3-yl)phthalide, 3,3-bis(phenylindol-3-yl)phthalides such as 3,3-bis(1,2-dimethylindol-3-yl)-phthalide, 3-(phenyl)-3-(heterocyclic-substituted)phthalides such as 3-(p-dimethylaminophenyl)-3-(1-methylpyrr-2-yl-6-dimethylaminophthalide, indole and carbazole-substituted phthalides such as 3,3-bis(1,2-dimethylindol-3-yl)-5-dimethylaminophthalide and 3,3-bis(9-ethylcarbazol-3-yl)-5-dimethylaminophthalide, and substituted indole phthalides such as 3-(1,2-dimethylindol-3-yl)-3-(2-methylindol-3-yl)phthalide.

Other color formers also useful in the practice of this invention include indole substituted pyromellitides such as 3,5-bis-(p-diethylaminophenyl)-3,5-bis(1,2-dimethylindol-3-yl)pyromellitide, 3,7-bis-(p-diethylaminophenyl)-3,7-bis-(1,2-dimethylindol-3-yl)pyromellitide, 3,3,7,7--tetrakis-(1,2-dimethylindol-3-yl)pyromellitide and 3,3,5,5-tetrakis-(1,2-dimethylindol-3-yl)pyromellitide; and leucauramines and substituted leucauramines such as p-xylyl-leucauramine and phenylleucauramine. Also included are orthohydroxybenzoacetophenone, 2,4-bis[p-(p-dimethylaminophenylazo)aniline]-6-hydroxy-symtriazine, N,3,3-trimethylindolinobenzospiropyrans, and N,3,3-trimethylindolino-$\beta$-naphthospiropiranes.

An auxiliary coloring agent can be employed with the above color formers to provide fade resistance where fading is a problem. Many phthalide compounds such as crystal violet lactone for example, are characterized by rapid color development with a normal tendency to fade during the course of time. One suitable auxiliary coloring agent is benzoyl leuco methylene blue which oxidizes when released on the paper to slowly form a permanent blue color. The combination of a phthalide color former and such a colorless oxidizable auxiliary coloring agent provides a composition having both rapid color development and fade resistance.

The dye solvent compositions of this invention which are useful in pressure-sensitive copying paper systems comprise:

A. About 45 to 55 weight percent of hydrogenated terphenyl having no greater than about 40% hyrogenation; and B. about 55 to 45 weight percent of i. hexylbenzene; or ii. a composition comprising about 45 to 75 weight percent $C_{10}$ to $C_{16}$ alkanes and the balance $C_7$ to $C_{10}$ alkylbenzenes.

Surprisingly, it has been found that blends of the same components wherein the hydrogenated terphenyl is present in about 70 parts by weight and the alkylbenzene component is present in about 30 parts by weight, exhibit comparatively slow color development. The reasons therefor are not fully understood.

The solvent compositions of this invention are liquids at room temperature. Thus, they may be used alone in the microcapsule or may be combined with one or more diluents. For purposes of this invention the term "diluent" includes both inert or substantially inert materials which are of little practical use alone as dye solvents either because they have poor solvating power for the color former or because they act in some way to inhibit the development of color. Kerosene, paraffin oil, mineral spirits, castor oil, lard oil, olive oil, sardine oil, cottonseed oil, coconut oil and rapeseed oil are illustrative of prior art diluents. The diluent is usually employed in small amounts within the dye solvent composition, for example, in the range of from 0 to about 3 parts of diluent for each part of solvent. The diluents function to alter physical properties of the dye solvent compositions such as viscosity or vapor pressure as may be desired for handling or processing consideration.

The diluents may also serve to reduce the total cost of the solvent composition in the system.

The dye solvent compositions of this invention may also contain certain additives specifically intended to alter or control the final properties of the fluid as, for example, viscosity control agents, vapor pressure control agents, freezing point depressants, odor masking agents, antioxidants, colored dyes and the like.

In a preferred embodiment of the present invention, the color former is dissolved in a selected dye solvent composition to form a marking liquid which is reactive with the coreactant material on the CF sheet. Unexpectedly superior results were achieved herein with the resin type co-reactant materials. Within this class of co-reactant materials are phenolic polymers, phenol-acetylene polymers, maleic acidrosin resins, partially or wholly hydrolyzed styrene-maleic anhydride copolymers and ethylene-maleic anhydride copolymers, carboxy polymethylene and wholly or partially hydrolyzed vinyl methyl ether, maleic anhydride copolymers and mixtures thereof.

The dye solvent compositions of this invention, with or without the presence of a diluent, are microencapsulated according to procedures well-known and broadly described in the art. The microcapsules are typically coated onto one surface of a CB sheet and the resin co-reactant material is carried on one surface of the CF sheet.

To illustrate the superiority of the dye solvent compositions of this invention, the rate and extent of color development of several solvents was determined in a laboratory procedure. Some of the tested solvents were within the scope of the present invention and some were outside. The laboratory procedure consisted of preparing a marking fluid comprising a solution of a color former in the solvent or solvent composition to be tested, applying the fluid to CF paper coated with a phenolic resin co-reactant material, and measuring the print speed and color intensity.

In the test procedure the marking fluid was prepared by adding sufficient crystal violet lactone color former to the solvent composition to achieve 1.5 weight percent concentration of the color former. This was followed by agitation and warming to 100°–120°C. if necessary to achieve solution. The solution was then cooled to room temperature, seeded with a few crystals of the color former, and allowed to stand for several days with occasional shaking to assure that the solution was not supersaturated.

The solvent/color former solution was thereupon saturated into a blotter. The blotter was daubed seven times with a pencil eraser. The material on the pencil eraser, approximately 1 microliter of the solvent/color former solution, was transferred to a phenolic resin CF sheet and color intensity was measured. A Macbeth digital read-out Reflection Densitometer was employed using filters for color. The optical density measurements were seen visually and were recorded on a Sanborn Recorder which plots optical density versus time.

Print speed is defined herein as the time (in seconds) from injection of the solvent/color former solution until an optical density of 40 is achieved on the CF sheet. It has been found difficult to visually distinguish color change above a value of 40.

Color intensity for each of the samples tested was derived from the recording at a defined elapsed time.

The results of tests evaluating representative solvent compositions of this invention in comparison to related prior art compositions are presented in the Table which follows. The Table illustrates the generally superior performance obtained with the solvents of this invention. It also illustrates the surprising lack of performance on resin CF sheets for related compositions outside the present invention. The specific materials presented in the Table are for purposes of illustration only and the present invention is not to be limited thereto. Of those solvents illustrated in the Table, only solvents B and D are considered to fall within the scope of this invention.

TABLE

PHENOLIC RESIN OF SHEET

| Solvent | Solvent Composition (by weight) | Print Speed (Seconds) | Percent Color Development at 15 sec. | at 30 sec. | at 60 sec. |
|---|---|---|---|---|---|
| A | 70% Terphenyl at 30% hydrogenation; 30% of a 70:30% blend of $C_{13}$–$C_{15}$ alkanes and $C_9$–$C_{10}$ alkylbenzenes | 18 | | | 72 |
| B | 50% Terphenyl at 30% hydrogenation; 50% of a 70:30% blend of $C_{13}$–$C_{15}$ alkanes and $C_9$–$C_{10}$ alkylbenzenes | 9 | 64 | 72 | 73 |
| C | 70% Terphenyl at 30% hydrogenation; 30% Hexylbenzene | 15 | 39 | 72 | 77 |
| D | 50% Terphenyl at 30% hydrogenation; 50% Hexylbenzene | 8 | 69 | 75 | 76 |
| E | 50% Terphenyl at 30% hydrogenation; 50% of a 59:41% blend of $C_{12}$–$C_{14}$ alkylbenzene and $C_{10}$–$C_{11}$ alkylbiphenyl | 63 | 9 | 14 | 38 |
| F | 100% Monobenzylated ethylbenzene (a diphenyl alkane) | 4 | | | 81 |

Print speed and color development data presented in the above Table illustrate the surprising superiority of dye solvent compositions within the scope of the present invention. It was entirely unexpected that terphenyl hydrogenated to about 30% could give outstanding results on resin CF sheet. It was equally unexpected that the relative concentration of the two blend components in the composition would be so critical with respect to performance. That is, referring to solvents B and A, respectively, in the Table, it was unexpected that the print speed would double, i.e., from 9 seconds to 18 seconds, simply by increasing the hydrogenated terphenyl concentration in the blend from 50% to 70% by weight. The same trend is experienced when the second solvent in the composition is hexylbenzene. Compare solvents C and D.

Perhaps the most dramatic evidence of the surprising nature of the present invention is found in the poor performance of solvent E in the Table. Solvent E, containing a blend of alkylbenzene and alkylbiphenyl, exhibited an untenably high print speed of 63 seconds with a concomitant deficiency in color development. In comparison therewith, solvent D, which is within the present invention, exhibited a superior print speed of 8 seconds together with excellent color development properties.

Hydrogenated terphenyls described herein can be prepared according to established procedures well known in the literature. Hexylbenzene can likewise be prepared according to widely known and widely accepted techniques.

When component (B) of the solvent composition herein is a composition (or mixture) comprising $C_{10}$ to $C_{16}$ alkanes and $C_7$ to $C_{10}$ alkylbenzenes, the concentration may range from about 45 to 55 percent by weight although the preferred concentration is about 50 percent by weight.

The mixture of $C_{10}$ to $C_{16}$ alkanes and $C_7$ to $C_{10}$ alkylbenzenes is derived from petroleum sources. A preponderance of $C_{13}$ to $C_{15}$ components is generally found in the alkane (paraffin) portion of the mixture. Thus, $C_{13}$ to $C_{15}$ alkanes represent the preferred embodiment. The alkanes represent 45 to 75 weight percent of the mixture. The aromatic portion of the mixture, representing about 25 to 55 weight percent, consists essentially of $C_7$ to $C_{10}$ alkylbenzenes, predominantly $C_9$ to $C_{10}$ alkylbenzenes in most instances. Preferably, the aromatic portion or fraction of the mixture is present in about 25 to 30 weight percent.

Although the aromatic portion of the aforementioned mixture is referred to as "$C_7$ to $C_{10}$ alkylbenzenes", it is to be understood that certain unidentified aromatic and cycloparaffin compounds may be present therein. These compounds may occur naturally in this petroleum-based mixture. Typical compounds of this type might include alkyl indane, alkyl tetralin, naphthalene and the like, all in relatively small amounts if present.

When carbon numbers are employed herein in conjunction with alkylated aromatic compounds such as alkylbenzene or alkylbiphenyl, the numbers signify the carbon atom content of the alkyl groups and not the total carbon atom content of the aromatic molecule. For example, $C_{10}$ alkylbenzene would have a total carbon content of 16.

The embodiments of the invention in which an exclusive property or privilege is claimed are defined as follows:

1. A dye solvent composition for use in pressure-sensitive copying systems comprising:

A. About 45 to 55 weight percent of hydrogenated terphenyl having no greater than about 40% hydrogenation; and B. About 55 to 45 weight percent of i. hexylbenzene; or ii. a composition comprising about 45 to 75 weight percent $C_{10}$ to $C_{16}$ alkanes and the balance $C_7$ to $C_{10}$ alkylbenzene.

2. A composition of claim 1 wherein the terphenyl is hydrogenated to about 30%.

3. A composition of claim 2 wherein component (B) is hexylbenzene present in about 50 parts by weight.

4. A composition of claim 2 wherein component (B) is a composition comprising about 65 to 75 weight percent $C_{13}$ to $C_{15}$ alkanes and the balance $C_9$ to $C_{10}$ alkylbenzenes.

* * * * *